US012560389B2

(12) United States Patent
Doerbeck

(10) Patent No.: US 12,560,389 B2
(45) Date of Patent: Feb. 24, 2026

(54) HEAT STORAGE DEVICE, HEAT STORAGE SYSTEM AND METHOD FOR OPERATING A HEAT STORAGE DEVICE

(71) Applicant: Kraftanlagen Energies & Services SE, Munich (DE)

(72) Inventor: Till Doerbeck, Rosenheim (DE)

(73) Assignee: Kraftanlagen Energies & Services SE, Munich (DE)

( * ) Notice: Subject to any disclaimer, the term of this patent is extended or adjusted under 35 U.S.C. 154(b) by 762 days.

(21) Appl. No.: 17/631,070

(22) PCT Filed: Jul. 29, 2020

(86) PCT No.: PCT/EP2020/071373
§ 371 (c)(1),
(2) Date: Jan. 28, 2022

(87) PCT Pub. No.: WO2021/018949
PCT Pub. Date: Feb. 4, 2021

(65) Prior Publication Data

US 2022/0290929 A1 Sep. 15, 2022

(30) Foreign Application Priority Data

Jul. 29, 2019 (DE) ..... 10 2019 120 448.8

(51) Int. Cl.
*F28D 20/00* (2006.01)
*F24H 7/04* (2006.01)

(52) U.S. Cl.
CPC ..... *F28D 20/0056* (2013.01); *F24H 7/0416* (2013.01); *F28D 2020/0069* (2013.01)

(58) Field of Classification Search
USPC ..... 126/617
See application file for complete search history.

(56) References Cited

U.S. PATENT DOCUMENTS

| | | | | |
|---|---|---|---|---|
| 2,856,506 | A | 10/1958 | Telkes | |
| 4,286,141 | A | 8/1981 | MacCracken | |
| 5,038,850 | A | 8/1991 | Choi | |
| 5,680,503 | A * | 10/1997 | Abe | F01N 3/2828 422/174 |
| 10,168,105 | B2 * | 1/2019 | Wortmann | F28D 20/0039 |
| 2021/0310748 | A1 * | 10/2021 | Sanz | F28F 27/02 |

FOREIGN PATENT DOCUMENTS

| | | | |
|---|---|---|---|
| CN | 205481760 | U | 8/2016 |
| CN | 106017181 | A | 10/2016 |
| CN | 107246732 | A | 10/2017 |
| CN | 107606981 | A | 1/2018 |
| CN | 109595962 | A | 4/2019 |

(Continued)

OTHER PUBLICATIONS

PCT International Search Report and Written Opinion, PCT/EP2020/071373, Oct. 16, 2020, 15 pages.

(Continued)

*Primary Examiner* — Steven B Mcallister
*Assistant Examiner* — John E Bargero
(74) *Attorney, Agent, or Firm* — Quarles & Brady, LLP

(57) ABSTRACT

A heat storage device, a heat storage system comprising at least one heat storage device, and a method for operating a heat storage device.

9 Claims, 7 Drawing Sheets

(56) References Cited

FOREIGN PATENT DOCUMENTS

| | | | |
|---|---|---|---|
| CN | 209085409 | U | 7/2019 |
| DE | 102011109779 | A1 | 2/2013 |
| DE | 102015111235 | A1 | 9/2016 |
| DE | 102017217963 | A1 | 4/2019 |
| JP | 2015007493 | A | 1/2015 |

OTHER PUBLICATIONS

Australian Examination Report, corresponding to AU2020319665, dated Nov. 29, 2023.
China National Intellectual Property Administration, Notice of the First Review Opinion and Search Report, Application No. 202080054995.3, Feb. 15, 2025, 18 pages.
China National Intellectual Property Administration, Notice of the Second Review Opinion and Search Report, Application No. 202080054995.3, Jul. 30, 2025, 16 pages.

* cited by examiner

HEAT STORAGE DEVICE, HEAT STORAGE SYSTEM AND METHOD FOR OPERATING A HEAT STORAGE DEVICE

This application is the national phase application of International Patent Application No. PCT/EP2020/071373, filed on Jul. 29, 2020 which claims priority to German Patent Application No. 10 2019 120 448.8 filed on Jul. 29, 2019, which applications are hereby incorporated by reference in their entirety.

The disclosure relates to a heat storage device. Furthermore, the disclosure relates to a heat storage system. Moreover, the disclosure relates to a method for operating a heat storage device.

Heat storage devices have been known for a long time according to the state of the art. Heat storage devices are storage devices for thermal energy (energy storage devices). Heat storage devices can be built in different sizes, which encompass small decentral systems and large central storage devices. They are available both as short-term and as seasonal storage devices and can absorb and release low-temperature heat for heating rooms or high-temperature heat for industrial applications depending on their architecture. Hence, the most important aim of heat storage devices aside from storing thermal energy is to make it possible for generated heat to be used at a later point in time.

A heat storage device and a method for storing heat are known from DE 10 2017 217 963 A1. Devices and methods of this kind are used in particular in at least partially electrically driven motor vehicles (electric vehicles) in order to cover as much of the amount of heat required during operation with stored head and to thereby minimize the electrical energy consumption of components not relevant to propulsion.

The heat storage devices from the state of the art have a heat storage capacity that leaves room for improvement. In other words, the efficiency of the known heat storage devices can still be increased.

Hence, the object of the present disclosure is to overcome the disadvantages known from the state of the art.

This object is attained by a heat storage device having features as described herein, by a heat storage system comprising at least one heat storage device and having features as described herein, and by a method for operating a heat storage device having features as described herein.

The heat storage device according to the disclosure comprises a storage container for storing heat, the storage container having at least two openings, at least one heating element and at least one heat storage means being disposed in the storage container. In other words, a heating element in addition to a heat storage means is located within the storage container of the heat storage device.

The heat storage device has a support matrix for supporting the heating element. The presence of the support matrix allows the at least one heating element to be supported in a simple manner. Furthermore, multiple heating elements can be positioned at a defined distance from each other.

Preferably, the support matrix is disposed between the at least one heating element and the at least one heat storing means. Preferably, the heat storing means comprises the support matrix. In other words, the support matrix can be part of the heat storing means. Particularly preferably, the support matrix has an offset for accommodating the at least one heating element. This allows heating elements to be supported in a simple manner. The term support matrix can refer to a support or a mount. The support or the mount can be configured to accommodate the at least one heating element.

Further preferably, the support matrix has a plurality of components, in particular bars, which run horizontally and/or vertically in a plane formed by the support matrix. Further preferably, the support matrix has a frame accommodating or surrounding or enclosing said components. The support matrix can also be configured as a grid structure.

Particularly preferably, at least one cable or wire for supplying the heating elements with electricity is routed through the support matrix, in particular the components.

The term heat storage device refers to a storage device for thermal energy. Preferably, the heating element is a component of a heating device, the heating element being configured to be operated by means of a power supply of the heating device. Preferably, the heat storage container has insulation. The heat storage container can be interpreted as a storage container.

The heat storage device can be used to efficiently store excess electrical energy from highly fluctuating regenerative sources (such as wind or photovoltaics) or connected electrical grids in the form of heat at a high temperature level. This ensures a stabilization of the electrical grid. The heat stored within the storage container can be used—for example, for being converted into electricity as needed through a steam process, ORC, etc.—or be transferred to a process (industrial heat supply) at a later date.

Preferably, the following applies to an introduction of heat into the storage container:

- the heat storage device is configured to transport a gas into the storage container via at least one first opening,
- the heating element is configured to heat the transported gas,
- the storing means, which are disposed downstream of the heating element, are configured to store the heat of the heated gas, and
- the heat storage device is configured to transport the gas that has transferred the heat to the storing means and has consequently cooled back out of the storage contained via at least one second opening.

The gas transported into the storage container via the at least one first opening during the introduction of heat preferably has a temperature of ≤120°.

Thus, the heat storage device is configured to heat a gas, preferably air, or a gas flow, preferably an air flow, using electrical energy with the highest efficiency possible directly within the thermal storage container. Particularly preferably, the gas is heated to approximately 1000° C. The hot gas produced thereby subsequently flows through the heat storing means in order to transfer its heat to them.

In other words, the heat storage device allows a gas flow to be transported from the first opening through the storage container in the direction toward the second opening. The gas is heated by the heating element in the process and is guided to the storing means. There, the heat is transferred from the gas to the heat storing means and is stored by the latter.

Preferably, the heat storing means are stacked molded bricks. Preferably, the first opening and the second opening are connected to a circuit.

Particularly preferably, other openings besides the first opening and the second opening can be provided, said other openings allowing a gas flow to enter the interior of the storage container or to leave the storage container.

Preferably, the following applies to a withdrawal of heat from the storage container:

the heat storage device is configured to transport a gas into the storage container via the at least one second opening, the storing means are configured to transfer the stored heat to the gas and heat the latter, and the heat storage device is configured to transport the heated gas that has passed the storing means out of the storage container via the at least one first opening.

The gas transported through the at least one second opening during the withdrawal of heat from the storage container preferably has a temperature of ≤120°.

In a heat introduction direction, the heat storage device can comprise a first gas distribution chamber, which is disposed upstream of the heating element. Furthermore, the heat storage device can comprise a second gas distribution chamber, which is disposed downstream of the storing means, in a heat introduction direction. The presence of the gas distribution chambers allows a homogenous distribution of the entering gas across the cross section of the storage device to be achieved.

As mentioned above, other openings besides the first opening and the second opening can be provided, said other openings allowing a gas flow to enter the interior of the storage container or to leave the storage container.

Preferably, spaces between at least two adjacent heating elements are hermetically sealed. Thus, horizontal spaces between the heating elements through which no gas is supposed to flow can be sealed. The spaces are preferably airtight, resistant to heat and/or electrically insulating. Chamotte or a fiber insulant can be used as material, for example.

Further preferably, a flow homogenizer can be disposed on either side of the heating element. The term flow homogenizer can refer to a flow equalizer. Alternatively, a flow homogenizer can be disposed on either side of multiple layers of heating elements and between the same. The presence of the flow homogenizer allows an additional homogenization of the gas flow to be achieved. The flow homogenizer can be composed of a ceramic material or a metallic material or a combination of different materials in the form of bulk material, foam, a grid or a perforated plate, for example. The flow homogenizer on top of the heating elements can differ from the flow homogenizer at the bottom or between the heating elements in terms of material and structure. The flow homogenizer on top of the heating elements can be configured to be walked on for maintenance purposes.

Particularly preferably, at least two layers of heating elements are stacked on top of each other. The presence of multiple layers of heating elements allows the installed thermal capacity to be adapted to greatly varying gas volume flows by switching individual heating element layers on and off.

Particularly preferably, the at least one heating element through which the gas can flow comprises an electrically conductive metallic or ceramic honeycomb structure. Preferably, the honeycomb structure is a honeycomb body. The honeycomb structure can have any overall cross section, such as a circle, a rectangle, a square, a hexagon, a polygon or a spiral. The individual channels of the honeycomb structure can also have any cross section, such as a square, a hexagon, a circle or a wavy shape comparable in particular to corrugated cardboard. The honeycomb structure is configured to allow the gas or the gas flow to flow through it. When the heating element is activated, the honeycomb structure heats up in such a manner that the gas flowing through the honeycomb structure is heated as well.

The presence of the honeycomb structure results in a very large surface for transferring heat between the heating element and the gas flow and in an enlarged overall cross section on which the flow can act. The resulting low air speeds during the passage through the heating elements in combination with a preferably straight channel shape of the honeycombs lead to a minimized air resistance. The flow passes through the honeycomb structure or the channels of the honeycomb structure in the longitudinal direction. Furthermore, the amount of electrical energy consumed by, for example, a fan in storage mode is reduced.

Further preferably, the heating elements are disposed in the shape of a line or extend in a meandering or helical shape. The heating elements are disposed at the surface of the storage device or extend at the surface of the storage device. For example, a linear arrangement is particularly suitable for structurally identical, rectangular, oblong heating elements in storage containers having a square or rectangular flow cross section. Heating elements connected in series and disposed in a meandering shape are particularly suitable for distributing the heating elements evenly across a storage cross section of any shape, such as a circular or polygonal shape. A helical arrangement results in the option of disposing multiple heating element groups each composed of heating elements connected in series as spiral arms electrically connected in parallel around a central electrical connection point with the result that the number of holes required for electrical connections on the storage container is reduced to a minimum.

Particularly preferably, the heating elements are connected in series and/or in parallel. This allows the corresponding heating element to be energized, i.e., activated, depending on the application. The heating elements can be connected to available AC/DC voltage sources in the intermediate or low voltage range at 10 to 20 kV AC or 1000 to 1500 V DC in the case of larger installations, for example. The heating elements can be electrically connected in series and/or in parallel to form heating element groups depending on the shape and the electrical resistance.

Heating element groups of heating elements which can be switched on and off independently of each other can be formed.

Additionally, the output of the individual heating elements can be specifically changed by switching them on/off or changing the connection of the heating elements by means of a switching system outside of the storage container in order to minimize temperature differences in the heating gas at the storage surface.

Moreover, the thermal inertia of the overall system can be minimized since the heating elements rest on the storing means without any additional housing and heat insulation and therefore are part of the thermally exploitable overall storage mass themselves.

The heat storage system according to the disclosure comprises at least one heat storage device as described above, the heat storage device being connected to or interconnected with a heat consumer. A connection can be established via a pipe system.

Preferably, the storage system can comprise a pipeline system comprising at least one throttle member and/or at least one fan. The term throttle member can refer to a flap or a valve. The term fan can refer to a device that accelerates the gas or the gas flow upon activation.

The method according to the disclosure for operating a heat storage device comprises the following sequential steps for introducing heat into the storage container:

transporting gas into the storage container through the first opening, heating the transported gas by means of the heating element, storing the heat of the heated gas by means of the storing means, and transporting the gas that has transferred the heat to the storing means out of the storage container through the second opening.

Charging means introducing heat into the storage container. When the heat storage device is being charged, gas flows first through the at least one heating element and then through the storing means vertically from the top to the bottom. The heating means is activated, i.e., supplied with electricity, at the time. Preferably, a gas is heated from a temperature of ≤120° to approximately 800° C. to 1000° C. during the heat introduction.

Particularly preferably, the method for operating the heat storage device comprises the following sequential steps for withdrawing heat from the storage container:

transporting gas into the storage container through the second opening, transferring the heat from the storing means to the transported gas, and transporting the gas that has transferred the heat to the storing means out of the storage container through the second opening.

Discharging means withdrawing heat from the storage container. During the discharging of the heat storage device, gas flows through the storing means and the heating means vertically from the bottom to the top. The heating means is deactivated, i.e., no current is flowing, at the time. Alternatively, the heating means can also be activated in order to continue heating the exiting gas. Preferably, a gas is heated from a temperature of ≤120° to approximately 800° C. to 1000° C. during the heat withdrawal.

Hereinafter, the disclosure is discussed in more detail with reference to the accompanying drawings.

Figure 1:
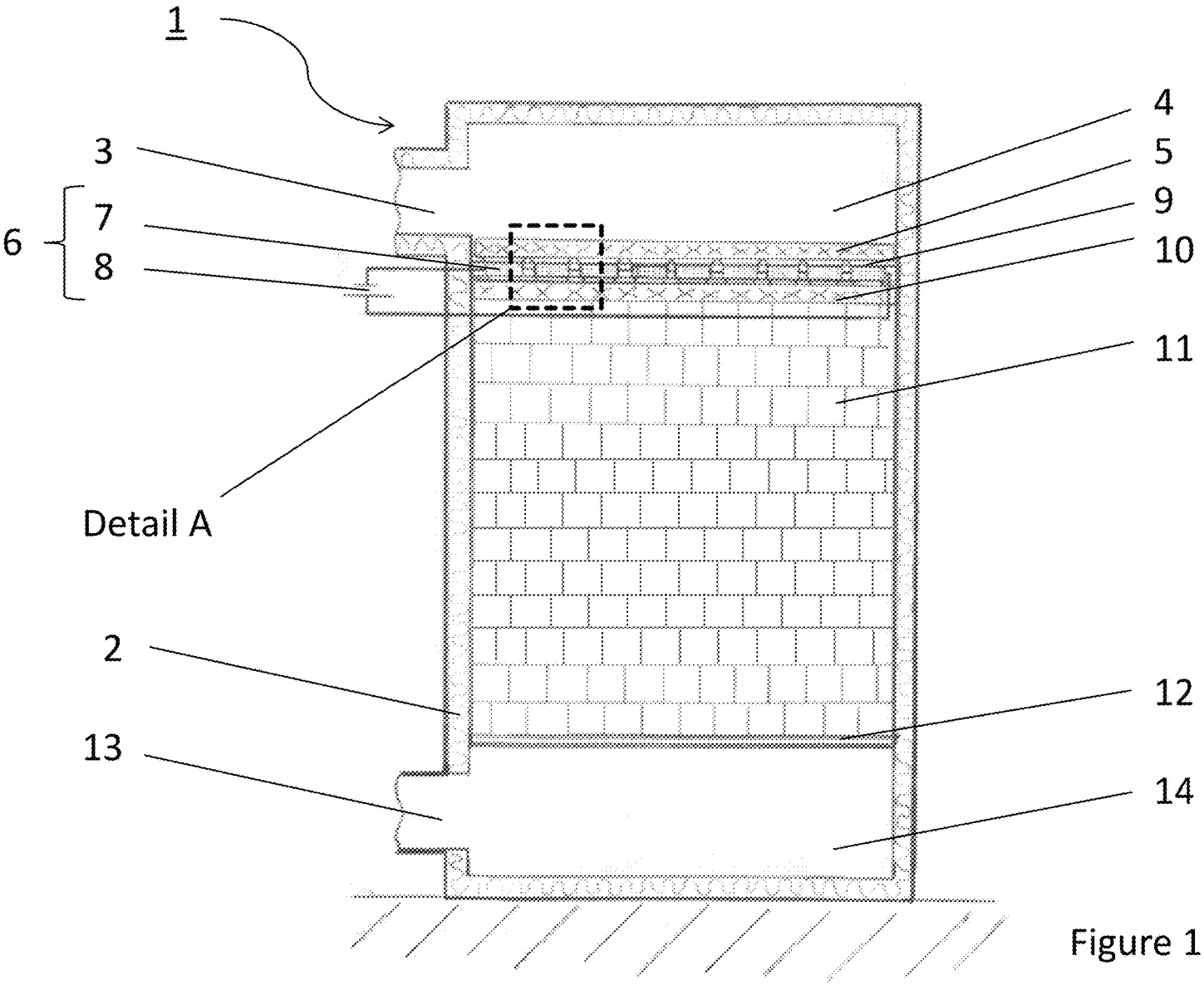
FIG. 1 is a schematic section through an embodiment of the device according to the disclosure.

In FIG. 1, a heat storage device 1 comprising a storage container 2 for storing heat is shown, storage container 2 having at least two openings 3, 13. A plurality of heating elements 7 and heat storing means 11 are disposed in storage container 2. Heat storing means 11 are stacked molded bricks which serve to store heat or absorb heat in the first instance.

A first gas distribution chamber 4 is disposed downstream of a first opening 3 in a transport direction of the gas. Gas distribution chamber 4 serves to homogenize the inflowing gas. Gas distribution chamber 4 is followed by a first flow homogenizer 5. First flow homogenizer 5 additionally serves to homogenize the gas. Heating elements 7 are disposed downstream of first flow homogenizer 5. Heating elements 7 are part of a heating device 6.

Figure 2:
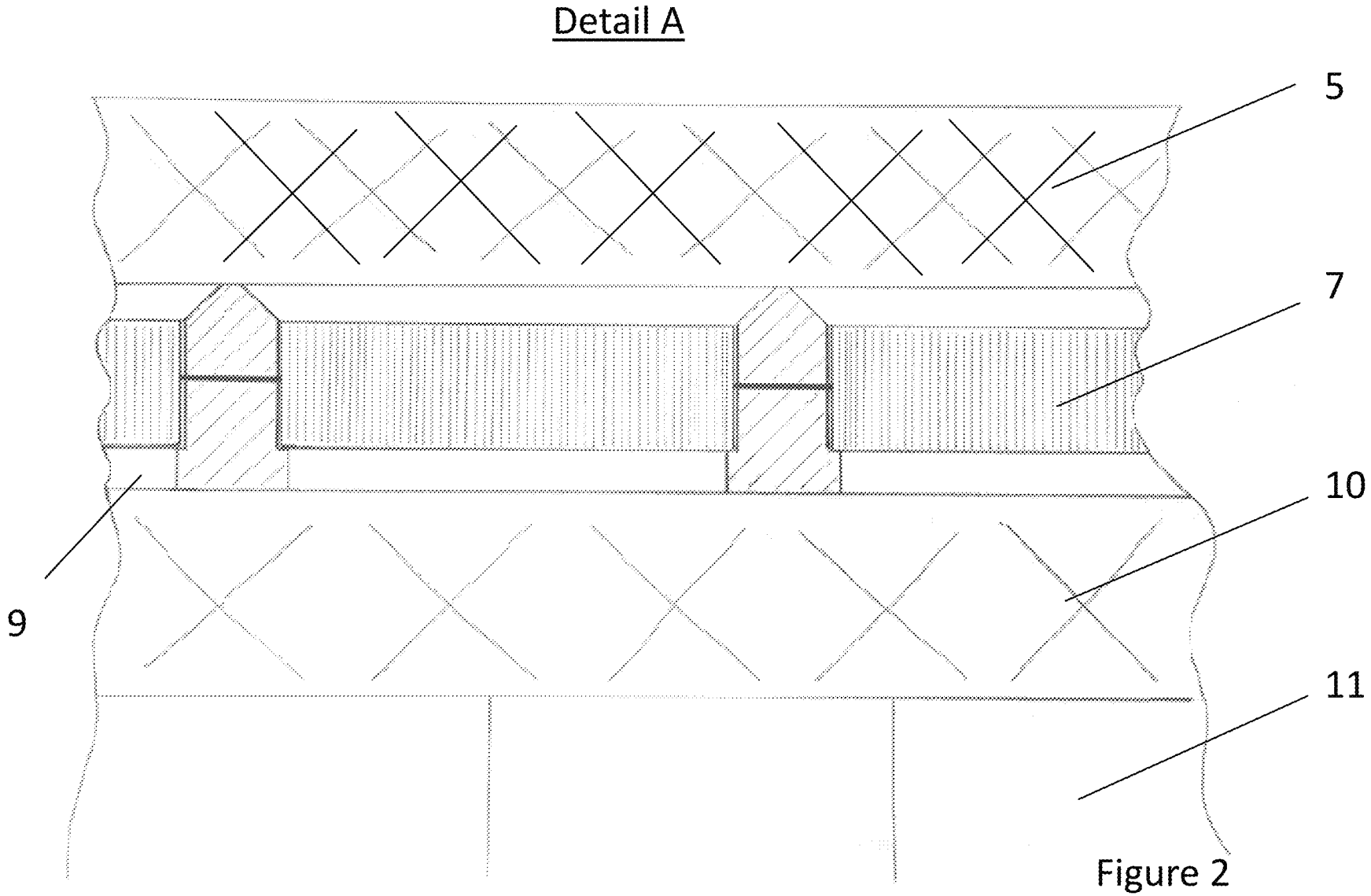
FIG. 2 shows a detail A of FIG. 1.

A support matrix 9 is provided for supporting heating elements 7, as shown in detail in FIG. 2. For supplying heating element 7 with electricity, heating device 6 additionally has an electrical power supply 8 including lines. A second flow homogenizer 10 is connected downstream of support matrix 9 and heating elements 7. Both first flow homogenizer 5 and second flow homogenizer 10 are optional.

Second flow homogenizer 10 is followed by heat storing means 11. As mentioned above, heat storing means 11 are molded bricks, which are stacked at an offset. A support 12 is provided between a second gas distribution chamber 14 and molded bricks 11. A second opening 13 is disposed downstream of second gas distribution chamber 14.

Spaces between two adjacent heating elements 7 are hermetically sealed. Heat-resistant and electrically insulating materials can be used as materials for the hermetic seal. Heating elements 7 can be connected in series or in parallel.

Figure 5:
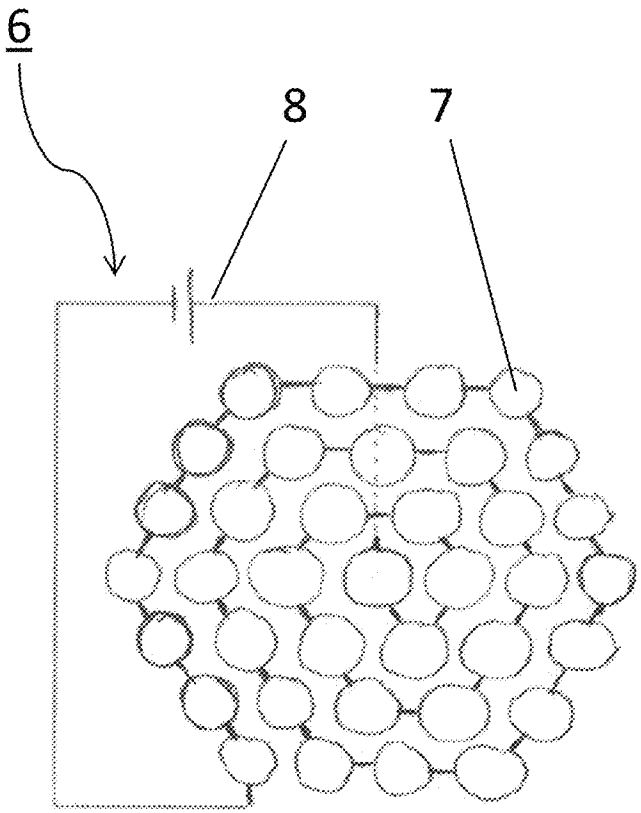
FIG. 5 shows another alternative embodiment of the heating device of FIG. 1.
Figure 3:
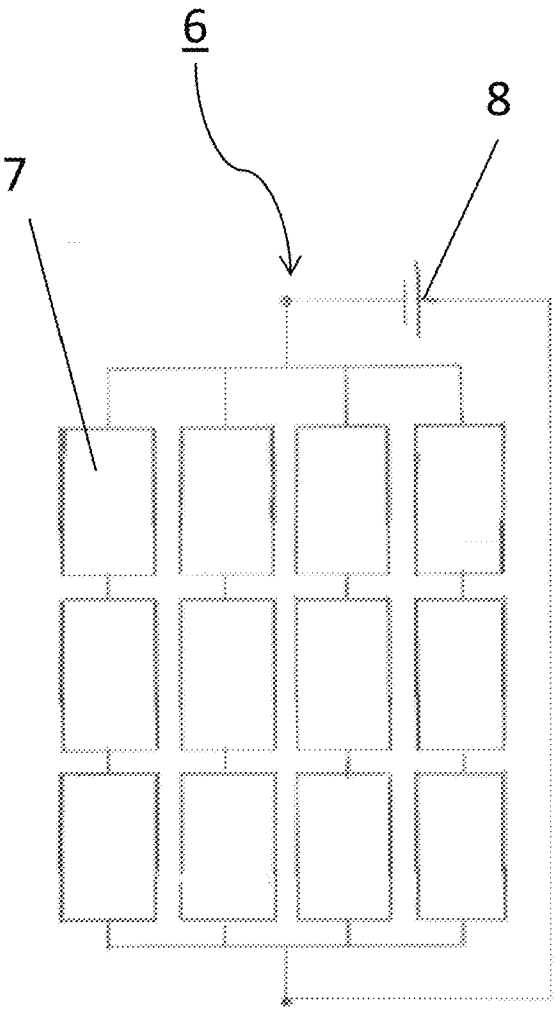
FIG. 3 is a schematic top view of a heating device according to FIG. 1.

As shown in FIGS. 1 and 2, heating elements 7 are disposed at the surface of the storage device. Heating elements 7 can be disposed in different shapes. FIG. 3 shows a circuitry in which four rows of heating elements 7 are connected in parallel. According to FIG. 4, heating elements 7 are connected in series one behind the other, heating elements 7 extending in a meandering shape. According to FIG. 5, heating elements 7 are connected in series one behind the other, heating elements 7 extending in a helical shape.

Figure 4:
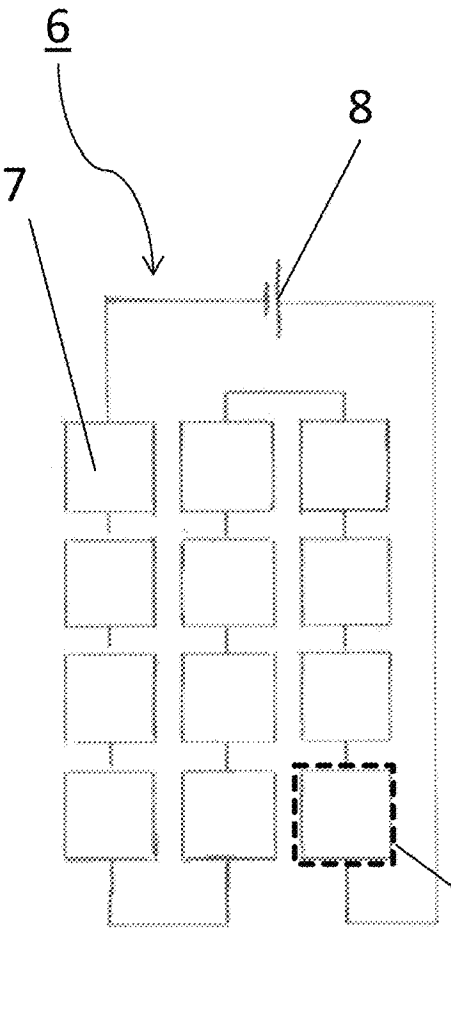
FIG. 4 shows an alternative embodiment of the heating device of FIG. 1.
Figure 6:
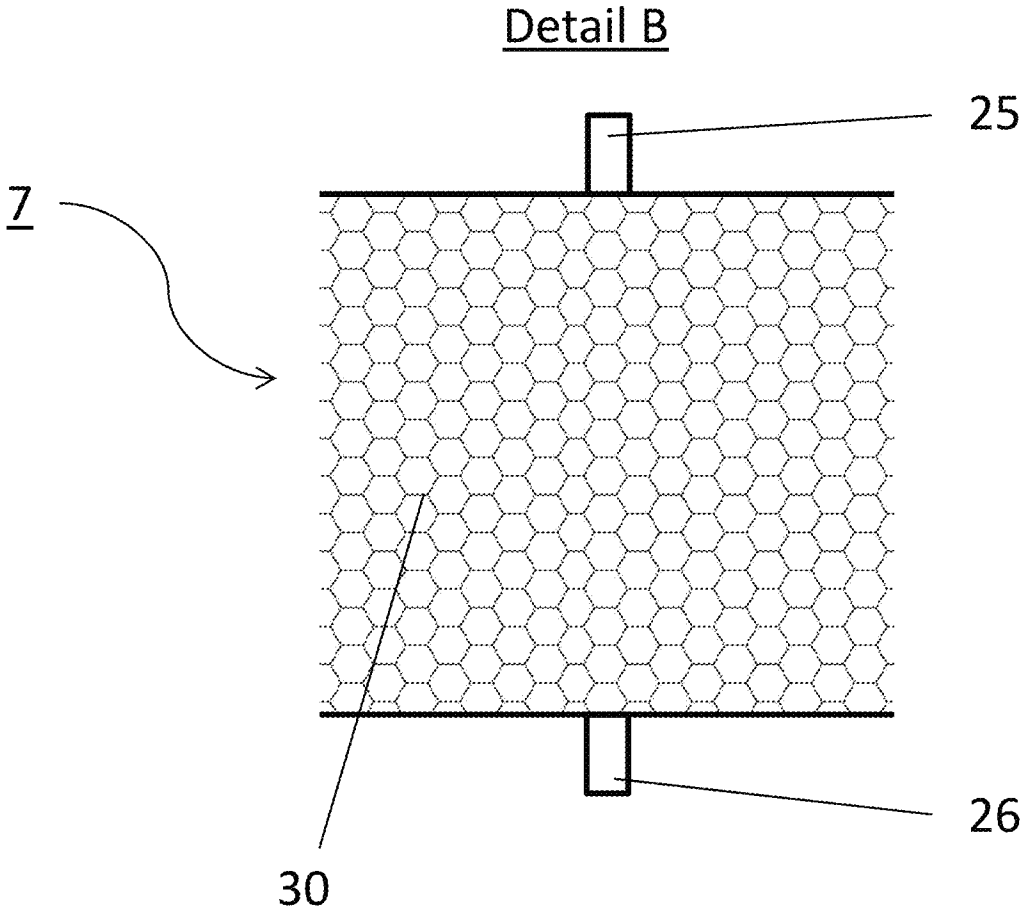
FIG. 6 shows a detail A of FIG. 4.

FIG. 6 is a top view of a heating element 7 of FIG. 4 with electrical connections 25, 26. Heating element 7 has a rectangular cross section with a honeycomb structure or a honeycomb body 30 with hexagonal channels. The gas or the gas flow flows through honeycomb structure 30 of heating element 7 perpendicularly with respect to the drawing plane, i.e., into or out of the drawing plane. In other words, the gas flows through the honeycomb structure or the channels of the honeycomb structure in the longitudinal direction. The presence of the honeycomb structure 30 results in an enlarged overall cross section on which the flow can act, a large surface for transferring heat, and a straight channel shape with low flow resistance. Alternatively, other shapes are conceivable for the honeycomb body 30, such as a circle, an oval, a rectangle or a polygon. Other shapes are also conceivable for the honeycomb channels, such as a square, a circle, a hexagon or a wavy shape comparable in particular to corrugated cardboard.

Figure 7:
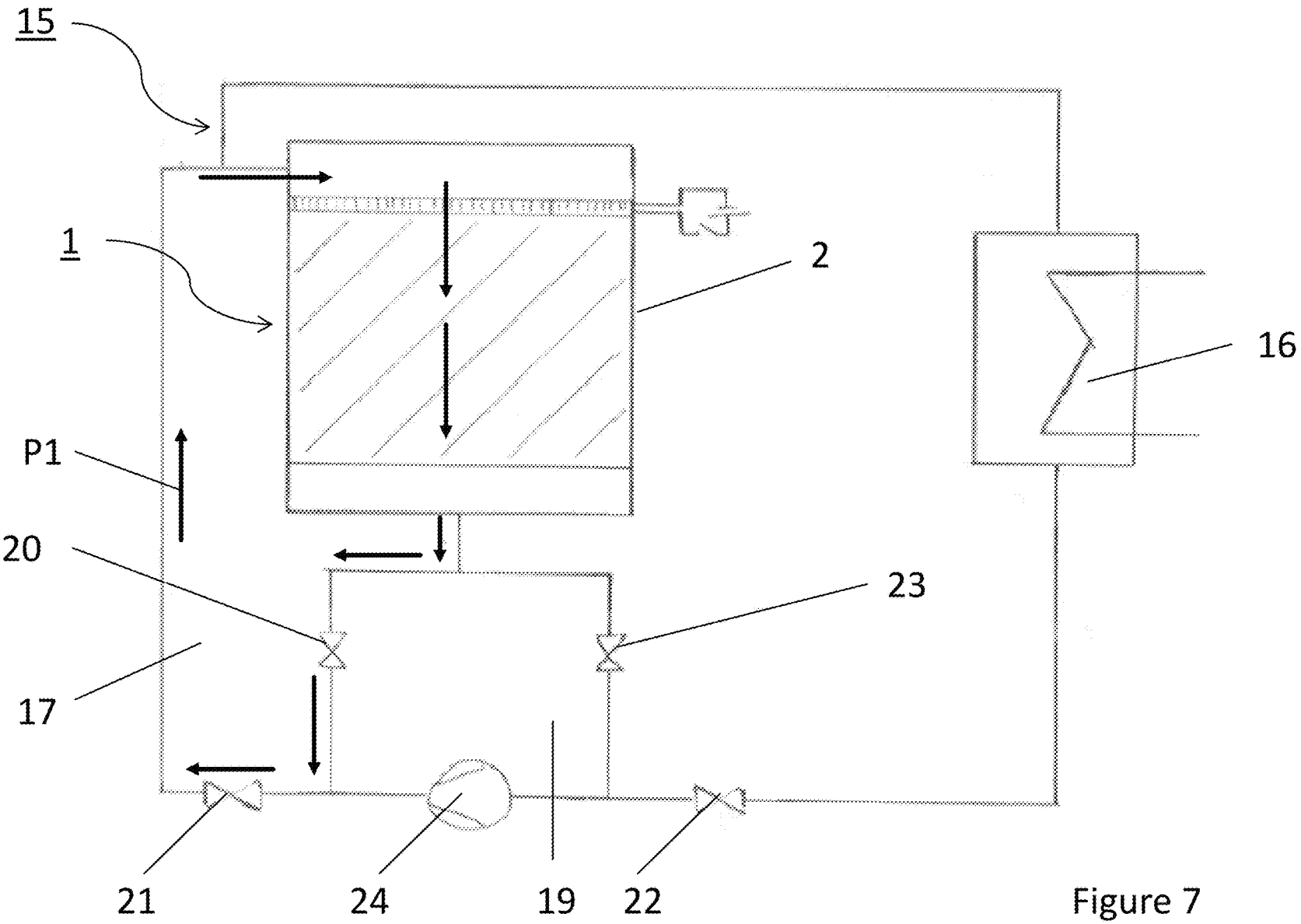
FIG. 7 is a schematic view of an embodiment of a heat storage system according to the disclosure in charging mode.

FIG. 7 shows a heat storage system 15 comprising a heat storage device 1 according to FIG. 1. Heat storage system 15 has a heat consumer 16 in addition to heat storage device 1. Heat consumer 16 is connected to heat storage device 1 via a pipeline system.

Furthermore, FIG. 7 shows a circuit 17. First circuit 17 serves to charge heat storage device 1. Charging means introducing heat into storage container 2. Arrows P1 illustrate the flow direction of the gas in circuit 17. Circuit 17, which comprises pipelines, has to throttle members 23, 21. Throttle members 23, 21 can be used to influence the flow speed of the gas flow.

Heat storage device 1 (see FIG. 1) is configured to transport a gas into storage container 2 via first opening 3. Heating element 7 is configured to heat the transported gas. Storing means 11, which are disposed downstream of heating element 7, are configured to store the heat of the heated gas. Furthermore, heat storage device 1 is configured to transport the gas that has transferred the heat to storing means 11 and has consequently cooled back out of storage container 2 via second opening 13.

Figure 8:
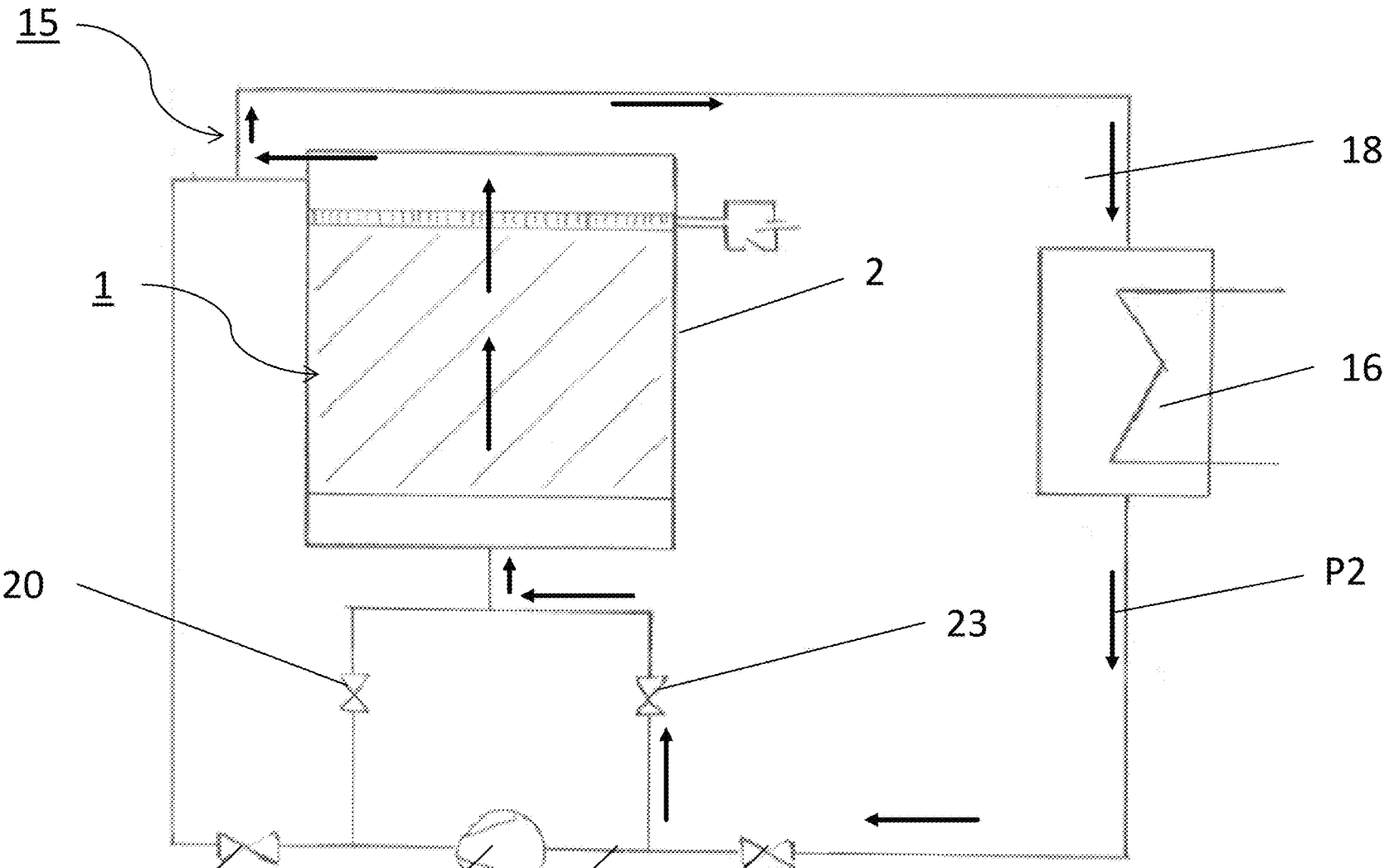
FIG. 8 shows the embodiment according to FIG. 7 in discharging mode.

Contrary to FIG. 7, FIG. 8 shows a discharging of the heat storage device. In FIG. 8, a second circuit 18 is shown. Second circuit 18, which comprises pipelines, serves to discharge heat storage device 1. Discharging means withdrawing heat from storage container 2. Arrows P2 illustrate the flow direction of the gas in circuit 18. Circuit 18 has two throttle members 22, 20. Throttle members 22, 20 can be used to influence the flow speed of the gas flow.

Heat storage device 1 (see FIG. 1) is configured to transport a gas into storage container 2 via second opening 13. Storing means 11 are configured to transfer the stored heat to the gas and heat it. Furthermore, heat storage device 1 is configured to transport the heated gas that has passed storing means 11 back out of storage container 2 in the direction of consumer 16 via the at least one first opening 3.

Moreover, heat storage system 15 has a pipeline 19, which comprises a fan 24.

Figure 9:
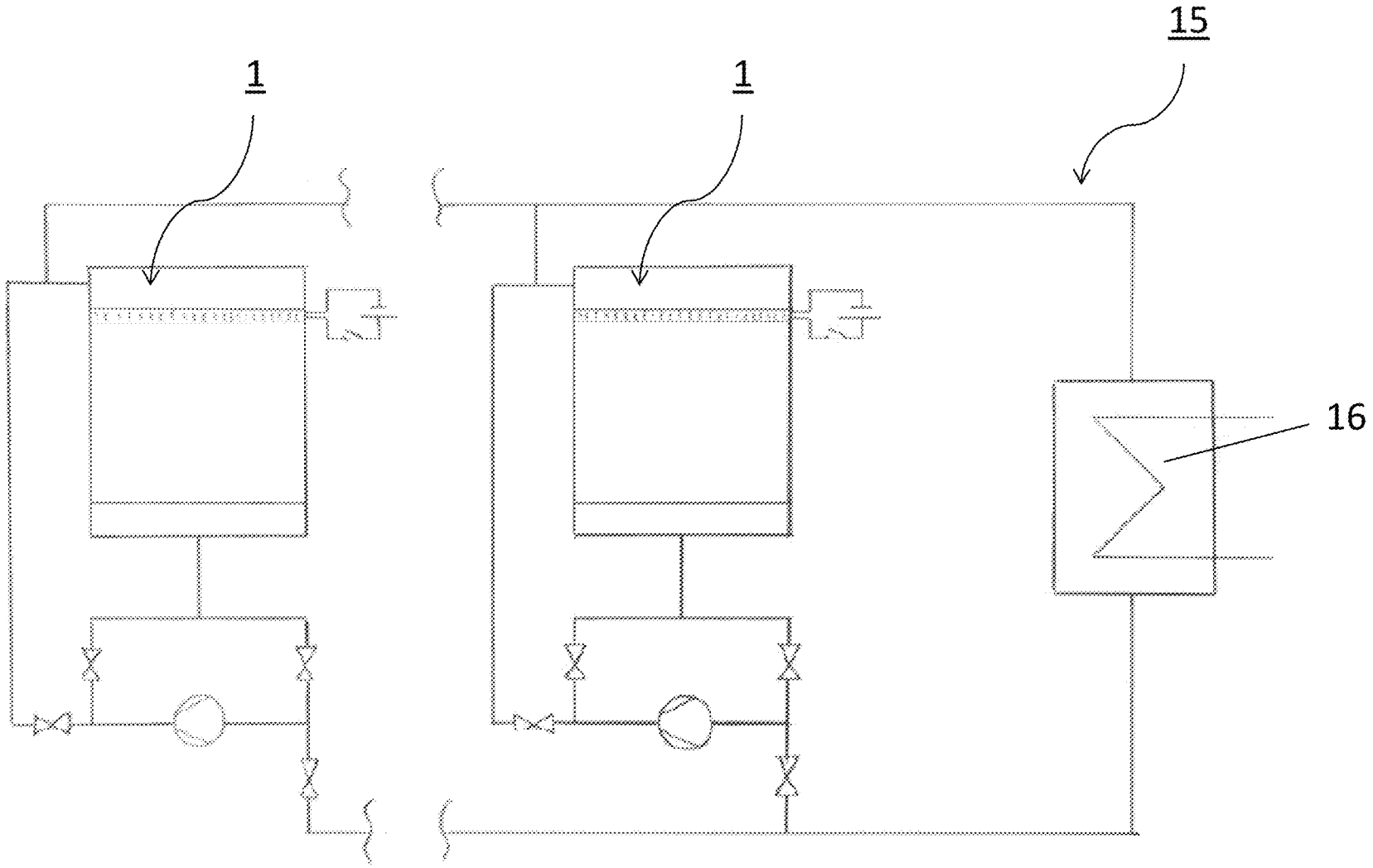
FIG. 9 is a schematic view of another embodiment of the heat storage system.

FIG. 9 shows another heat storage system 15. Unlike in the case of heat storage system 15 according to FIGS. 7 and 8, other heat storage devices 1 in addition to the one heat storage device 1 are present in heat storage system 15, only one of these multiple other heat storage devices 1 being shown for reasons of clarity.

The presence of heat storage device 1 or of heat storage system 15 as described above allows excess electrical energy from highly fluctuating regenerative sources or connected power grids, for example, to be efficiently stored in the form of heat at a high temperature level so as to thereby stabilize the power grid.

REFERENCE SIGNS

1 heat storage device
2 storage container
3 first opening
4 first gas distribution chamber
5 first flow homogenizer
6 heating device
7 heating element
8 power supply
9 support matrix
10 second flow homogenizer
11 heat storing means
12 support
13 second opening
14 second gas distribution chamber
15 heat storage system
16 heat consumer
17 circuit
18 circuit
19 pipeline
20 throttle member
21 throttle member
22 throttle member
23 throttle member
24 fan
25 connection
26 connection
30 honeycomb structure (honeycomb body)
P1 arrow (flow direction)
P2 arrow (flow direction)

The invention claimed is:

1. A heat storage device comprising a storage container for storing heat, the storage container having at least two openings, at least one heating element and heat storing means being disposed in the storage container, and the heat storage device having a support matrix for supporting the heating element, wherein the heat storage device comprises a first gas distribution chamber disposed upstream of the heating element at a top of the device and a second gas distribution chamber disposed downstream of the storing means in a heat introduction direction at a bottom of the device, wherein a flow homogenizer is disposed on either side of the heating element or on either side of multiple layers of heating elements and/or between these layers, wherein when the heat storage device is being charged, gas flows first through the at least one heating element and then though the storing means moving vertically through the heat storage device from the top to the bottom, and the gas distribution chambers provide a homogeneous distribution of the gas across the cross section of the storage device;

wherein, for introducing heat into the storage container, the heat storage device is configured to transport a gas into the storage container via at least one first opening, the heating element is configured to heat the transported gas, the storing means, which are disposed downstream of the heating element, are configured to store the heat of the heated gas, and the heat storage device is configured to transport the gas that has transferred the heat to the storing means out of the storage container via at least one second opening, wherein, for withdrawing heat from the storage container, the heat storage device is configured to transport a gas into the storage container via the at least one second opening, the storing means are configured to transfer the stored heat to the gas and heat the gas, and the heat storage device is configured to transport the heated gas that has passed the storing means out of the storage container via the at least one first opening.

2. The heat storage device according to claim 1, wherein spaces between at least two adjacent heating elements are hermetically sealed.

3. The heat storage device according to claim 1, wherein at least two layers of heating elements are stacked on top of each other.

4. The heat storage device according to claim 1, wherein the at least one heating element comprises an electrically conductive metallic or ceramic honeycomb structure through which the gas is able to flow.

5. The heat storage device according to claim 1, wherein the heating elements are disposed in a line or extend in a meandering or helical shape.

6. The heat storage device according to claim 1, wherein the heating elements are connected in series and/or in parallel.

7. A heat storage system comprising at least one heat storage device according to claim 1, wherein the heat storage device is connected to a heat consumer.

8. The heat storage system according to claim 7, the heat storage system having a pipeline system comprising at least one throttle member and/or at least one fan.

9. A method for operating a heat storage device, including a storage container for storing heat, the storage container having at least two openings, at least one heating element and heat storing means being disposed in the storage container, and the heat storage device having a support matrix for supporting the heating element, wherein the heat storage device comprises a first gas distribution chamber disposed upstream of the heating element at a top of the device and a second gas distribution chamber disposed downstream of the storing means in a heat introduction direction at a bottom of the device, wherein a flow homogenizer is disposed on either side of the heating element or on either side of multiple layers of heating elements and/or between these layers, wherein when the heat storage device is being charged, gas flows first through the at least one heating element and then though the storing means moving vertically through the heat storage device from the top to the bottom, and the gas distribution chambers provide a homogeneous distribution of the gas across the cross section of the storage device, the method comprising the following sequential steps for introducing heat into the storage container:

transporting gas into the storage container through the first opening, heating the transported gas by means of the heating element, storing the heat of the heated gas by means of the storing means, and transporting the gas that has transferred the heat to the storing means out of the storage container through the second opening;

the method comprising the following sequential steps for withdrawing heat from the storage container:

transporting gas into the storage container through the second opening, transferring the heat from the storing means to the transported gas, and transporting the gas that has transferred the heat to the storing means out of the storage container through the second opening.

* * * * *